US005390817A

United States Patent [19]

Rosén

[11] Patent Number: 5,390,817

[45] Date of Patent: Feb. 21, 1995

[54] PACKAGING CONTAINER

[75] Inventor: Ake Rosén, Helsingborg, Sweden

[73] Assignee: Tetra Laval Holdings & Finance SA, Pully, Switzerland

[21] Appl. No.: 122,284

[22] Filed: Sep. 17, 1993

[30] Foreign Application Priority Data

Sep. 28, 1992 [SE] Sweden ..... 9202784

[51] Int. Cl.[6] ..... B65D 90/02

[52] U.S. Cl. ..... 220/669; 206/518

[58] Field of Search ..... 229/111; 220/669, DIG. 13; 206/518, 519, 520, 499

[56] References Cited

U.S. PATENT DOCUMENTS

| | | | |
|---|---|---|---|
| Re. 12,770 | 3/1908 | Brown | 229/111 |
| 1,892,531 | 12/1932 | McKee | 220/DIG. 13 |
| 3,165,234 | 1/1965 | Conklin et al. | 206/518 |
| 3,407,969 | 10/1968 | Klein et al. | 229/111 |
| 4,157,762 | 6/1979 | Robinson | 220/DIG. 13 |
| 4,593,816 | 6/1986 | Langenbeck | 206/518 |
| 4,616,762 | 10/1986 | Alexander | 206/518 |
| 4,715,911 | 12/1987 | Johansson et al. | 156/69 |
| 4,826,013 | 5/1989 | Heikkinen | 206/518 |
| 5,014,500 | 5/1991 | Richie | 53/559 |

FOREIGN PATENT DOCUMENTS

| | | |
|---|---|---|
| 2364259 | 6/1975 | Germany . |
| 146424 | 11/1978 | Norway . |
| 1405019 | 9/1975 | United Kingdom . |

*Primary Examiner*—Joseph Man-Fu Moy
*Attorney, Agent, or Firm*—Burns, Doane, Swecker & Mathis

[57] ABSTRACT

A packaging container which is deep drawn from a thermoformable material includes a first part and a second part. The first part is provided with a front plane, a top plane, a bottom plane and two side planes. The second part is mountable on the first part to define a rear plane of the container. The front plane of the container forms an angle of less than 90° with the bottom plane and an angle of greater than 90° with the top plane.

11 Claims, 2 Drawing Sheets

PACKAGING CONTAINER

FIELD OF THE INVENTION

The present invention relates to a packaging container and more particularly, to a packaging container which is deep drawn from a thermoformable material and which is provided with an opening arrangement.

BACKGROUND OF THE INVENTION

In the packaging industry which produces single-use disposable packages for foods such as milk or juice, the aim is to produce a package which is simple to manufacture and which is made from economical material. The package should, for the most part, also be recyclable.

Thermoformed liquid packages which are known in the art are formed by making a deep drawn hollow body which is often conical. These conical hollow bodies are mostly prefabricated and thereafter stacked within one another prior to being filled.

The thermoformed packages may be manufactured from different thermoformable plastics such as polypropylene. Polypropylene with a filler is an excellent material since it imparts greater rigidity to the package. The filler may consist of, for instance, lime, mica, kaolin or chalk.

OBJECTS AND SUMMARY OF THE INVENTION

One object of the present invention is to design a thermoformed hollow body such that its opening forms the major defining surface of the hollow body, this surface being covered by a second container part after filling. As a result of this design and construction, the packaging container may be filled more rapidly, and it is possible to work with a smaller deep drawing relationship between the processed surface and the drawing depth, since the deep drawn part need not be made as deep in order to achieve the desired hollow body volume.

Furthermore, the large opening of the hollow body results in a long, continuous seal with double material thickness around the largest circumference of the package, which rigidities the package and moreover makes it easier to handle for the consumer, since the rigidifying frame which forms the seal also constitutes a gripping edge when the package is to be used.

These and other objects are achieved by providing a deep drawn packaging container with a front plane, a top plane, and a bottom plane, wherein the front plane makes an angle of less than 90° with the bottom plane and an angle of more than 90° with the top plane.

BRIEF DESCRIPTION OF THE DRAWING FIGURES

One preferred embodiment of the present invention will now be described in greater detail hereinbelow, with particular reference to the accompanying drawing figures in which like elements are identified with like reference numerals and wherein.

Figure 4A:
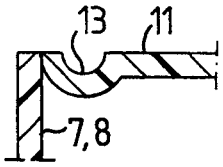
Figure 4B:
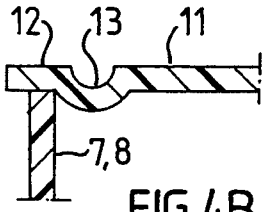
Figure 4C:
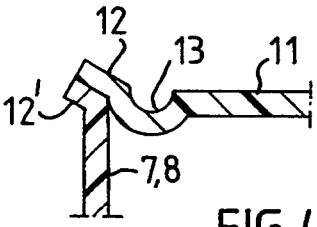
Figure 5:
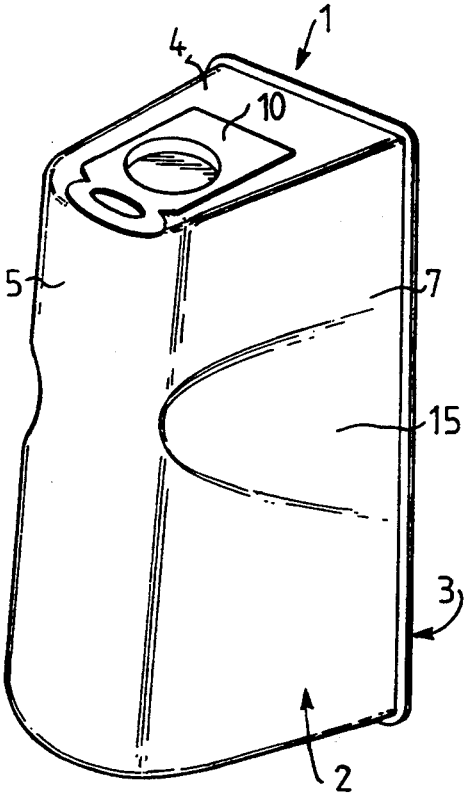

FIGS. 4 A–C are enlarged cross-sectional views of different embodiments of the joint between the two parts of the package; and FIG. 5 is a top perspective view of another preferred embodiment of the container.

DETAILED DESCRIPTION OF PREFERRED EMBODIMENT

Figure 1:
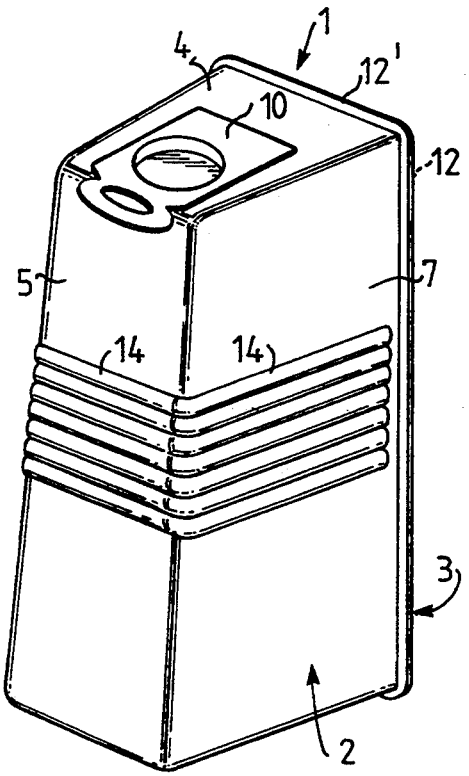
FIG. 1 is a top perspective view of one preferred embodiment of the packaging container.

A packaging container 1 according to FIG. 1 is manufactured from a material which must be thermoformable, since at least one part of the packaging container is deep drawn to form a hollow body 2. Furthermore, it is desirable that the material is economical to use and it should, moreover, be up to one hundred percent recyclable. In this instance, it has been found that polypropylene with an extender or filler which rigidifies the packaging container 1 is an excellent packaging material. The filler may, for instance, consist of lime or chalk which may be added to the plastic material in a quantity of up to between 60 and 70 weight percent of the finished packaging material. A second packaging container part 3 is thermoformed in the same material.

Figure 2:
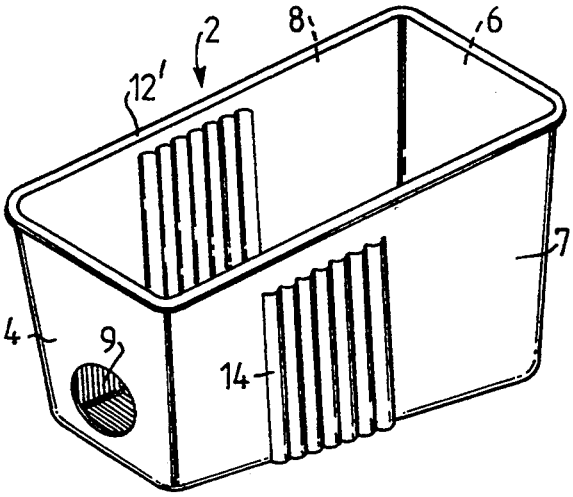
FIG. 2 is a top perspective view of a part of a package.
Figure 3:
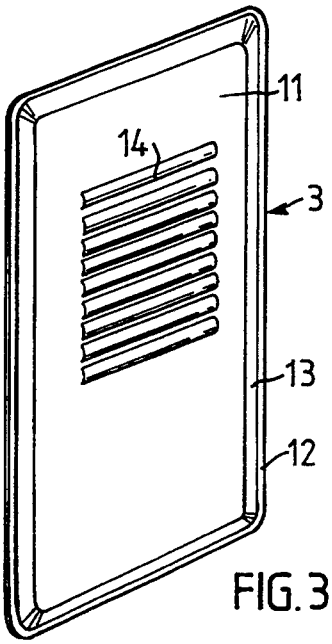
FIG. 3 is a top perspective view of another part of the package.

The two parts of the packaging container 2 and 3 according to FIGS. 2 and 3 may be prefabricated before filling and delivered to a dairy or juice factory stacked in one another. The hollow body 2 according to FIG. 2 is deep drawn from a thermoformable material, but it may also be injection moulded. It is also conceivable to supply the intended packaging material in rolls to the dairy where forming by means of deep drawing or vacuum forming takes place before the packaging containers 1 are filled.

The hollow body 2 which constitutes one part of the packaging container 1 as shown in FIG. 2, consists of five planes 4, 5, 6, 7 and 8. As a result of the positional relationship between these planes 4, 5, 6, 7 and 8, the body will be provided with a favourable release angle so that the parts 2 may be nested and easily drawn out from the stack for filling. Alternatively, the parts 2 may be turned the same direction in the stack or may be turned through 180° between each part 2. The hollow body 2 is drawn obliquely out of the stack at an obtuse angle between the top plane 4 of the packaging container 1 and its front plane 5.

The opening surface of the hollow body 2 is not parallel with the front plane 5 of the package and makes an angle of less than 90° with all other planes 4, 6, 7 and 8 of the packaging part 2. The front plane 5 makes an angle which is larger than 90° with the top plane 4 and an angle which is less than 90° with the bottom plane 6 of the packaging container 1. The front plane 5 makes an angle of more than 90° in relation to both of the side planes 7 and 8 of the packaging container 1. This gives the hollow body 2 a bathtub like appearance thereby achieving the above-described advantages upon nesting of the part 2. The front plane 5 can be level as in FIG. 1 or curved as in FIG. 5.

The hollow body according to FIG. 2 is provided with an opening hole 9 in the top plane 4. This opening hole 9 is provided with an opening arrangement 10 which may be designed in different manners, but it is desirable that the opening arrangement 10 be reclosable after being opened for the first time. Furthermore, it is conceivable that an opening arrangement is thermoformed on, or in connection with the deep drawing of the hollow body 2. This thermoformed opening arrangement may, for example, be provided with a conventional screw cap. Upon filling of the packaging container 1, the opening arrangement 10 is disposed and sealed in place in the hole 9. The packaging container 1 is suitably filled with the hollow body 2 oriented with its open portion facing upwards, whereafter the hollow body is filled with the intended contents. The open portion of the hollow body 2 is covered in the finished, filled package 1 by the second package container part 3. Upon filling of the packaging containers, a plurality of packaging container parts 2 may be connected together so that they are filled simultaneously and thereafter covered by a common covering panel which forms the rear plane 11 for each of the packaging containers 1. Only at a later operational stage are the united packaging containers 1 separated to form individual packages 1.

The ready-filled hollow body 2 is covered with the packaging container part 3 according to FIG. 3, which will constitute the rear plane 11 of the packaging container 1. The container part 3 is provided with a flange 12 around the outer defining line of the plane 11 and, inside this flange 12, there is disposed a depression or channel 13. The flange 12 and the channel 13, whose outer edge fits in the opening of the hollow body 2, makes it possible for the container part 3 to remain in the intended position after insertion in the hollow body 2, which facilitates the welding operation of the flange 12 of the container part 3 against a corresponding flange around the opening of the hollow body 2. The depression or channel 13 may serve as a back-up surface in the same process, or make possible the application of a back-up tool for forming a joint where the one joint portion consists of the outer wall section of the depression 13. FIGS. 4 A–C show different embodiments of the flange 12 and the depression 13.

In FIG. 4C, the flange 12 is angled towards the rear plane 11, with the result that any sealing fin directly projecting from the support surface of the package 1, the bottom plane 6, will be avoided. In FIG. 4A there is no flange 12 on the package part 3, but instead the rear plane 11 is fitted exactly into the opening of the thermoformed hollow body 2. However, this version requires considerable precision in securing the different package parts 2 and 3.

The two package container parts 2 and 3 are provided with rigidifying beads 14 which are placed approximately centrally on the finished package 1 as shown in FIG. 1, with a level front plane 5. In addition to rigidification, these beads 14 also provide an improved gripping surface when the consumer handles the package I and pours out its contents. The other embodiment of the invention as shown in FIG. 5 has concave depressions 15 on each of the side planes 7 and 8, the depression serving as gripping surfaces. Of course, the level or the curved front plane 5 can be combined either with beads 14 or depressions 15.

As will have been apparent from the foregoing description, the present invention realizes a single-use disposable package which is up to one hundred percent recyclable, since it is manufactured from one and the same material. Because of the long rigidifying sealing fin which extends along the largest wall side of the package, the package is very firm to grip, even though the packaging material is thin and the package itself is simple and economical to manufacture. Because of the design of the deep drawn part, the prefabricated parts can quite simply be nested together in a stack and quite simply drawn out of the nested stack on filling and finishing of the packaging container.

While this invention has been illustrated and described in accordance with a preferred embodiment, it is recognized that variations and changes may be made, and equivalents employed herein, without departing from the invention as set forth in the claims.

What is claimed is:

1. A packaging container which is deep drawn from a thermoformable material, a first part of the container including a front wall; two side walls; a top wall and a bottom wall; said first part being adapted to be joined together with a second part for forming a rear wall of the container, the top wall being provided with an opening arrangement, the front wall forming an angle of less than 90° with the bottom wall and an angle of more than 90° with the top wall, and each of the side walls forming an angle of greater than 90° with the front wall to thereby facilitate nesting of the first part with another first part.

2. The packaging container as claimed in claim 1, wherein the front wall is curved.

3. The packaging container as claimed in claim 1, including rigidifying beads provided on at least one of the front wall, the rear wall and the two side walls.

4. The packaging container as claimed in claim 1, wherein the first part is provided with a flange and a depression located inside the flange.

5. The packaging container as claimed in claim 4, wherein the flange forms an angle of less than 180° with the rear wall when the second part is attached to the first part.

6. The packaging container as claimed in claim 1, the opening arrangement includes a covering panel fixedly sealed over a hole in the top wall.

7. The packaging container as claimed in claim 1, wherein the opening arrangement includes a prefabricated pouring spout having a push-on lid, said pouring spout including a flange sealed to the top wall.

8. The packaging container as claimed in claim 9, wherein the two side walls are provided with concave depressions.

9. A packaging container, comprising a first part which is a deep drawn body of thermoformable material having oppositely positioned top and bottom walls, a front wall which is connected to the top and bottom walls, and two oppositely positioned side walls which are each connected to the front wall, the top wall and the bottom wall, said first part having an open side located opposite the front wall, said open side being adapted to be covered by a second part to form a rear wall of the container when the second part is attached to the first part, said top wall being provided with a through hole, and a reclosable opening arrangement mounted on the first part to cover the through hole, said front wall forming an angle of less than 90° with the bottom wall and an angle of greater than 90° with the top wall, and each of the side walls forming an angle of greater than 90° with the front wall to thereby facilitate nesting of the first part with another first part.

10. The packaging container as claimed in claim 9, wherein said front wall is curved.

11. The packaging container as claimed in claim 9, wherein said side walls are provided with beads for rigidifying the body and facilitating gripping of the container.

* * * * *